US012339053B2

(12) United States Patent
Miao et al.

(10) Patent No.: US 12,339,053 B2
(45) Date of Patent: Jun. 24, 2025

(54) AIR-COOLED REFRIGERATOR WITH EVAPORATOR AT BOTTOM OF CABINET

(71) Applicants: QINGDAO HAIER REFRIGERATOR CO., LTD., Shandong (CN); HAIER SMART HOME CO., LTD., Shandong (CN)

(72) Inventors: Jianlin Miao, Shandong (CN); Hui Liu, Shandong (CN); Lingyun Dong, Shandong (CN); Ming Wang, Shandong (CN)

(73) Assignees: QINGDAO HAIER REFRIGERATOR CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 165 days.

(21) Appl. No.: 18/020,970

(22) PCT Filed: Aug. 10, 2021

(86) PCT No.: PCT/CN2021/111718
§ 371 (c)(1),
(2) Date: Feb. 13, 2023

(87) PCT Pub. No.: WO2022/037437
PCT Pub. Date: Feb. 24, 2022

(65) Prior Publication Data

US 2023/0288121 A1 Sep. 14, 2023

(30) Foreign Application Priority Data

Aug. 18, 2020 (CN) ..... 202010833950.8

(51) Int. Cl.
*F25D 21/08* (2006.01)
*F25D 17/06* (2006.01)
*F25D 21/14* (2006.01)

(52) U.S. Cl.
CPC ..... *F25D 17/067* (2013.01); *F25D 21/08* (2013.01); *F25D 21/14* (2013.01); *F25D 2321/144* (2013.01)

(58) Field of Classification Search
CPC .... F25D 21/08; F25D 21/14; F25D 2201/128; F25D 23/006; F25D 23/00; F25D 11/02
See application file for complete search history.

(56) References Cited

U.S. PATENT DOCUMENTS 2,994,207 A 8/1961 Preotle
3,027,735 A 4/1962 Preotle
3,393,530 A * 7/1968 Koch ..... F25D 21/08 62/275

FOREIGN PATENT DOCUMENTS

CN 208817767 U 5/2019
CN 110285629 A 9/2019
(Continued)

OTHER PUBLICATIONS

EPO, "Supplementary European Search Report for EP Application No. 21857532.2", Hague, Germany, Nov. 6, 2023.
(Continued)

*Primary Examiner* — Ana M Vazquez
(74) *Attorney, Agent, or Firm* — troutman pepper locke; Tim Tingkang Xia, Esq.

(57) ABSTRACT

Provided is an air-cooled refrigerator with an evaporator at the bottom of a cabinet thereof. The air-cooled refrigerator includes: a cabinet with a bottom liner; a partition cover plate transversely arranged in the bottom liner to divide the bottom liner into a storage space and a cooling chamber below the storage space; a return air cover arranged at the front of the cooling chamber and provided with at least one front return air inlet; and an evaporator, which is in a flat cuboid shape and is mounted in the cooling chamber in a manner of inclining upwards from front to back, where a
(Continued)

front portion of a top surface of the evaporator, the partition cover plate and the return air cover define a frost-accommodating space, such that some of the air that enters from the front return air inlet enters the evaporator from the frost-accommodating space.

14 Claims, 6 Drawing Sheets

(56) References Cited

FOREIGN PATENT DOCUMENTS

| | | | | | |
|---|---|---|---|---|---|
| CN | 110285630 | A | 9/2019 | | |
| CN | 110375504 | A | 10/2019 | | |
| CN | 209893734 | U | 1/2020 | | |
| CN | 211147012 | U | 7/2020 | | |
| WO | WO-2006013762 | A1 * | 2/2006 | ..... | F25D 21/08 |

OTHER PUBLICATIONS

Chinese Intellectual Property Office (ISR/CN), "International Search Report for PCT/CN2021/111718", China, Nov. 10, 2021.
SIPO, "1st CN Office Action and Search Report for CN Application No. 202010833950.8", China.

* cited by examiner

A-A

AIR-COOLED REFRIGERATOR WITH EVAPORATOR AT BOTTOM OF CABINET

CROSS-REFERENCE TO RELATED PATENT APPLICATION

This application is a U.S. national stage application of PCT Patent Application No. PCT/CN2021/111718 filed Aug. 10, 2021, which claims priority to and the benefit of Chinese Application No. 202010833950.8 filed Aug. 18, 2020, which are incorporated herein in their entireties by reference.

FIELD OF THE INVENTION

The present invention relates to the field of home appliances, and more particularly relates to an air-cooled refrigerator with an evaporator at a bottom of a cabinet.

BACKGROUND OF THE INVENTION

An existing bottom evaporator is horizontally placed, and a cover plate is commonly additionally arranged at an upper portion of the evaporator and an upper portion of a fan so as to partition the evaporator and a freezer compartment. Meanwhile, the cover plate needs to be attached to the evaporator as closely as possible so as to enlarge a usage space of the freezer compartment as large as possible. A thermal insulation layer needs to be arranged below the cover plate so as to guarantee temperature isolation between the evaporator and the freezer compartment. A cover plate assembly of the evaporator is commonly composed of the cover plate and the thermal insulation layer.

But the above settings will cause a series of problems. Since the cover plate assembly is completely attached to the evaporator, frost blockage is likely to happen after the evaporator is frosted, thereby causing practical refrigeration efficiency of the evaporator to be reduced, a defrosting period to be short, and complete-refrigerator energy consumption to be high. For a bottom evaporator structure, a return air inlet of the freezer compartment is located between a door body and the evaporator. Once frost blockage occurs to the evaporator, a phenomenon of poor air return will be caused, and consequently, an integral refrigeration effect is influenced.

BRIEF DESCRIPTION OF THE INVENTION

An objective of the present invention is to provide an air-cooled refrigerator with an evaporator at a bottom of a cabinet, which can solve any above problem.

A further objective of the present invention is to improve an air return structure and improve a refrigeration effect of the refrigerator.

Another further objective of the present invention is to improve a cooling chamber structure and reduce a phenomenon of evaporator frosting.

Particularly, the present invention provides an air-cooled refrigerator with an evaporator at a bottom of a cabinet. The refrigerator includes: the cabinet with a bottom liner; a partition cover plate transversely arranged in the bottom liner and used for dividing an internal space of the bottom liner into a cooling chamber and a storage space, where the cooling chamber is located below the storage space; a return air cover arranged at a front portion of the cooling chamber, where a top of the return air cover is connected to a front end of the partition cover plate, the return air cover is provided with at least one front return air inlet communicating the cooling chamber with the storage space, and air needed for heat exchange is provided for the cooling chamber through the front return air inlet; and the evaporator, where the evaporator is in a flat cuboid shape, and is arranged in the cooling chamber in a manner of inclining upwards from front to back, and a front portion of a top surface of the evaporator, the partition cover plate and the return air cover define a frost-accommodating space, thereby enabling a part of air inflow from the front return air inlet to enter the evaporator from the frost-accommodating space.

Further, the refrigerator further includes a top heating wire at least arranged at the front portion of the top surface of the evaporator and configured to provide heat needed by defrosting for the evaporator.

Further, the refrigerator further includes an evaporator heat preservation part arranged between the partition cover plate and the top of the evaporator. The evaporator heat preservation part includes: a filling portion, where an area, located behind the frost-accommodating space, between the partition cover plate and the top surface of the evaporator is filled with the filling portion; and a heating wire limiting portion extending forwards from the filling portion and provided with at least one downwards-protruding convex rib which can tightly press the top heating wire on the top surface of the evaporator.

Further, a plurality of convex ribs are located above a transverse middle portion and two transverse sides of the top heating wire respectively.

Further, the evaporator heat preservation part is formed by sequentially stacking a plurality of heat preservation layers different in material. The heat preservation layers include: a heat preservation foam layer attached to a lower surface of the partition cover plate; a resin film layer attached to a lower surface of the heat preservation foam layer; and a metal temperature equalization layer arranged on an outer side of the resin film layer and abutting against the top heating wire.

Further, a bottom wall of the bottom liner is further provided with a water receiving trough, and a bottom of the water receiving trough is provided with a water outlet. The air-cooled refrigerator further includes: a water pan arranged between the evaporator and the bottom wall of the bottom liner and configured to receive water on the evaporator, an area, opposite to the water receiving trough, of the water pan being provided with a plurality of through holes; and a bottom heating wire coiled between the water pan and the evaporator and configured to provide heat for defrosting of the evaporator.

Further, the bottom heating wire further includes: a front extension section which extends to a position in front of the evaporator from a bottom of the evaporator and is used for heating and melting away frost falling down from the frost-accommodating space during defrosting.

Further, power density of the front extension section is set to be less than or equal to 10 w/m.

Further, the return air cover is provided with: a first front return air inlet transversely formed in an upper portion of the return air cover; and a second front return air inlet transversely formed in a lower portion of the return air cover, so that air in the storage space flows towards the evaporator from an upper area and a lower area.

Further, an air duct back plate and a refrigeration fan are further included, where the air duct back plate is arranged in front of a rear wall of the bottom liner, defines, with the rear wall of the bottom liner, an air supply duct, and is provided with at least one air supply port used for communicating the air supply duct with the storage space; and the refrigeration fan is arranged behind the evaporator, an air outlet of the refrigeration fan is connected to a lower end of the air supply duct, and the refrigeration fan is configured to promote formation of a refrigeration airflow which flows into the evaporator from the front return air inlet and then is supplied to the air supply duct.

According to the air-cooled refrigerator with the evaporator at the bottom of the cabinet in the present invention, the front portion of the top surface of the evaporator, the partition cover plate and the return air cover define the frost-accommodating space, thereby enabling a part of air inflow from the front return air inlet to enter the evaporator from the frost-accommodating space. An original return air flow deflection angle is changed by the frost-accommodating space, so that the return air flow preferably flows through the frost-accommodating space with low flow resistance and then flows through the evaporator, thereby preventing frost of the evaporator from influencing the air flow, improving heat exchange efficiency, and further improving the refrigeration effect of the refrigerator.

Furthermore, according to the air-cooled refrigerator with the evaporator at the bottom of the cabinet in the present invention, the top heating wire is arranged at the front portion of the top surface of the evaporator. By means of the frost-accommodating space, a frosted position is transferred into the frost-accommodating space from the front portion of the evaporator, and the top heating wire is arranged at the front portion of the top surface of the evaporator in a centralized manner, thereby preventing heat of the heating wire from influencing refrigeration work of the evaporator during defrosting, optimizing a defrosting structure of the refrigerator, further improving refrigeration efficiency of the refrigerator, and reducing energy consumption.

Furthermore, according to the air-cooled refrigerator with the evaporator at the bottom of the cabinet in the present invention, the heating wire limiting portion limits the top heating wire at the top surface of the evaporator. The metal temperature equalization layer is arranged in the heating wire limiting portion and makes contact with the top heating wire, which can effectively transfer energy and prevent a local temperature of the top heating wire from being too high. The above settings simplify a limiting structure of the top heating wire, and the top heating wire is fixed only through the evaporator heat preservation part without additionally arranging an aluminum plate, thereby improving safety, simplifying the structure and facilitating installation.

Specific embodiments of the present invention are described in detail as below by combining drawings, and those skilled in the art will more clearly understand the above and other objectives, advantages and characteristics of the present invention.

BRIEF DESCRIPTION OF THE DRAWINGS

Some specific embodiments of the present invention are exemplarily described without limitation in detail by referring to the drawings below. Same reference numerals in the drawings indicate same or similar components or parts. Those skilled in the art should understand that the drawings are not necessarily drawn to scale. In the drawings.

DETAILED DESCRIPTION

Figure 1:
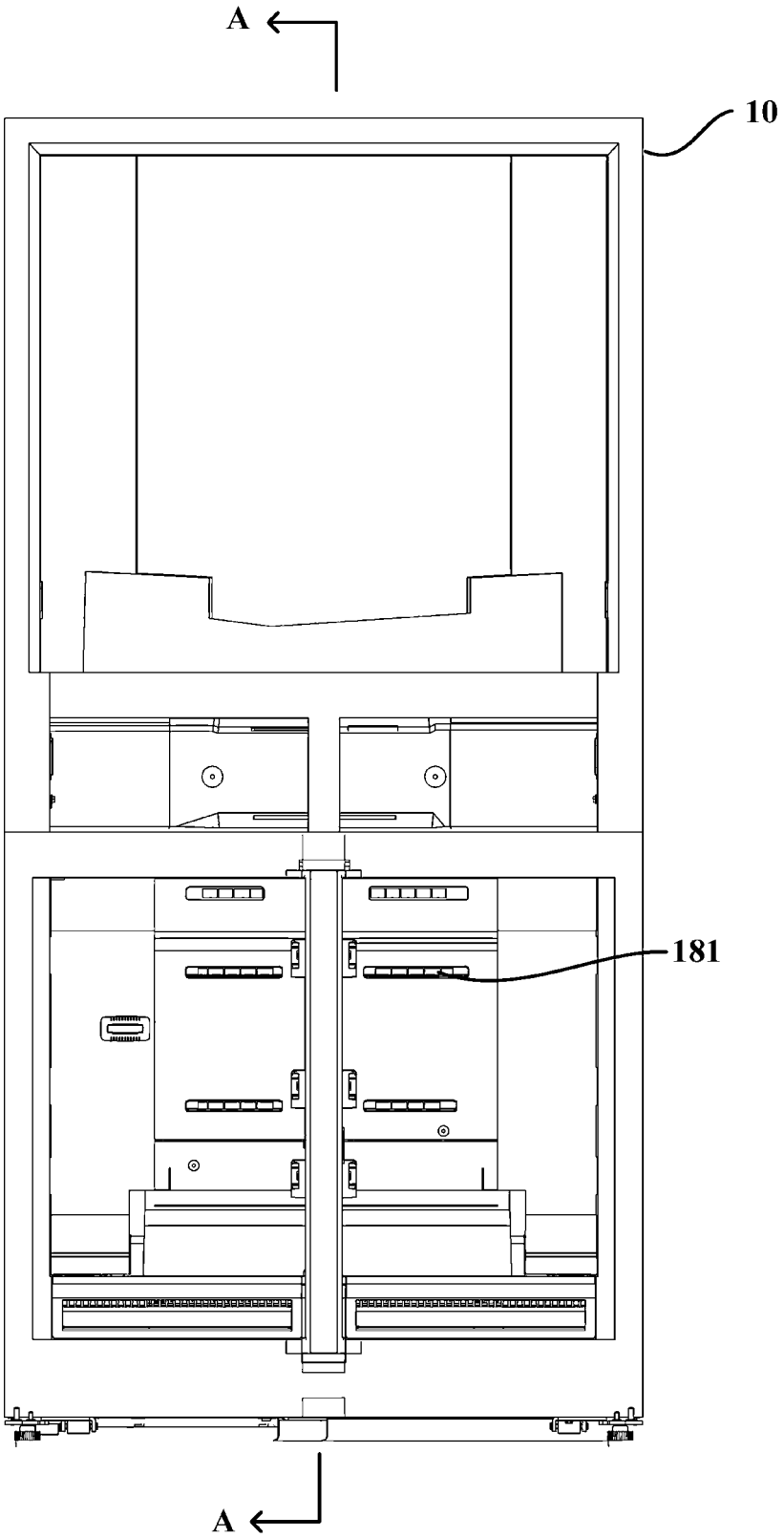
FIG. 1 is a schematic front view of a cabinet in an air-cooled refrigerator with an evaporator at a bottom of the cabinet according to an embodiment of the present invention.
Figure 2:
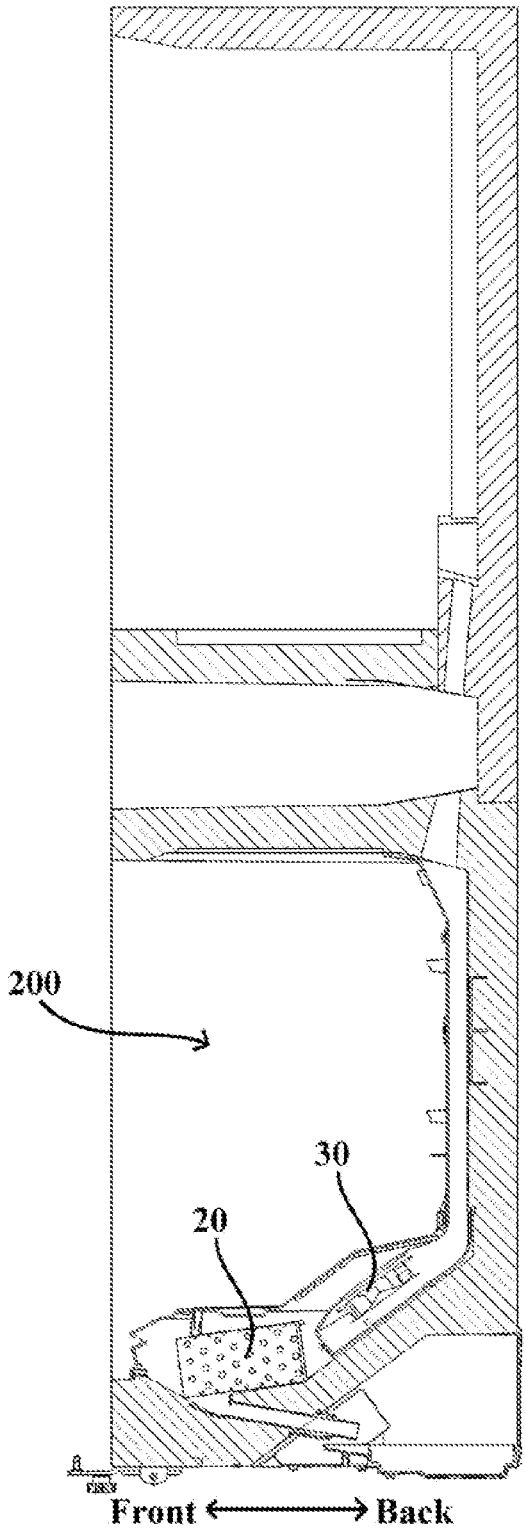
FIG. 2 is a schematic section view cut out along a section line A-A in FIG. 1.
Figure 3:
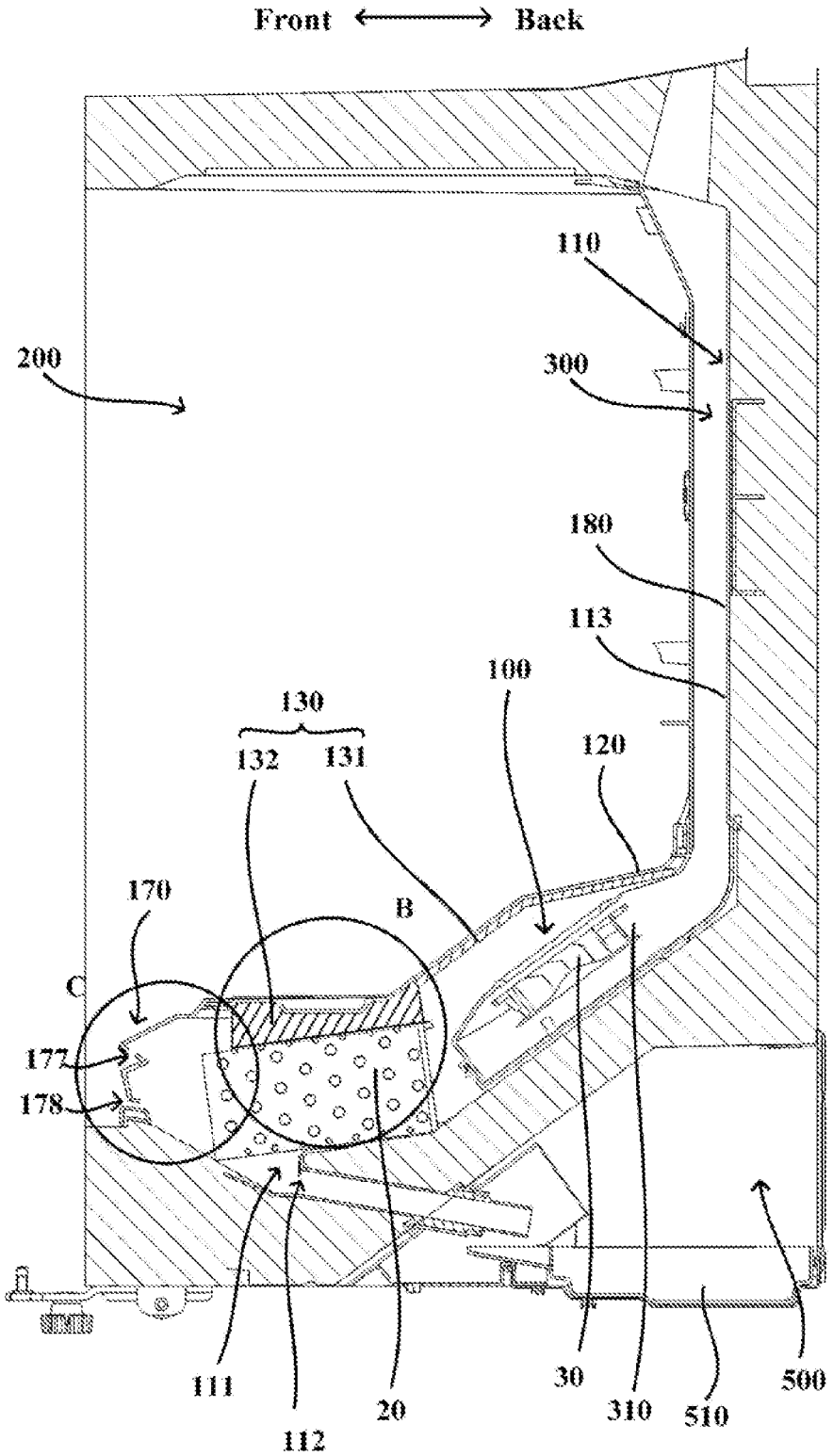
FIG. 3 is a schematic section view of a bottom of the cabinet of the air-cooled refrigerator with the evaporator at the bottom of the cabinet shown in FIG. 2.
Figure 4:
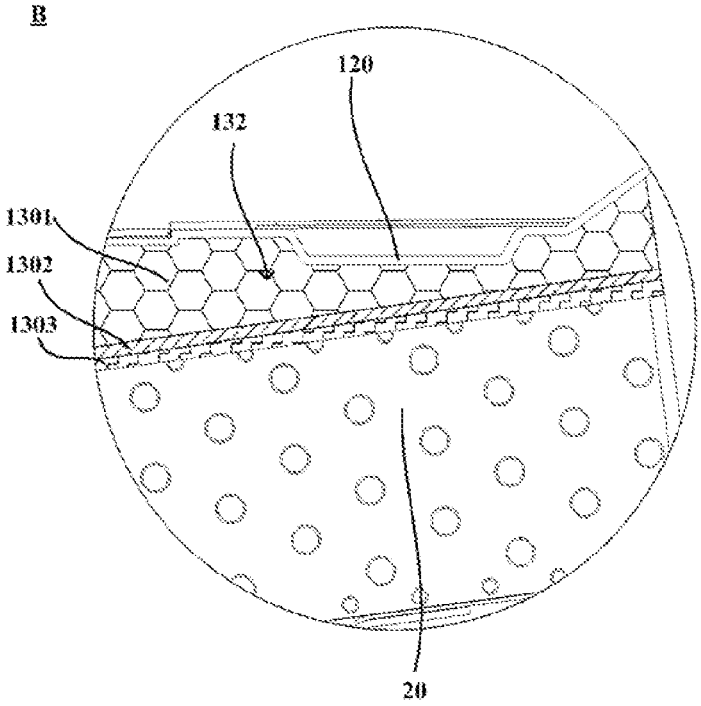
FIG. 4 is a schematic local enlarged view of an area B shown in FIG. 3, which shows a heating wire limiting portion of an evaporator heat preservation part.
Figure 5:
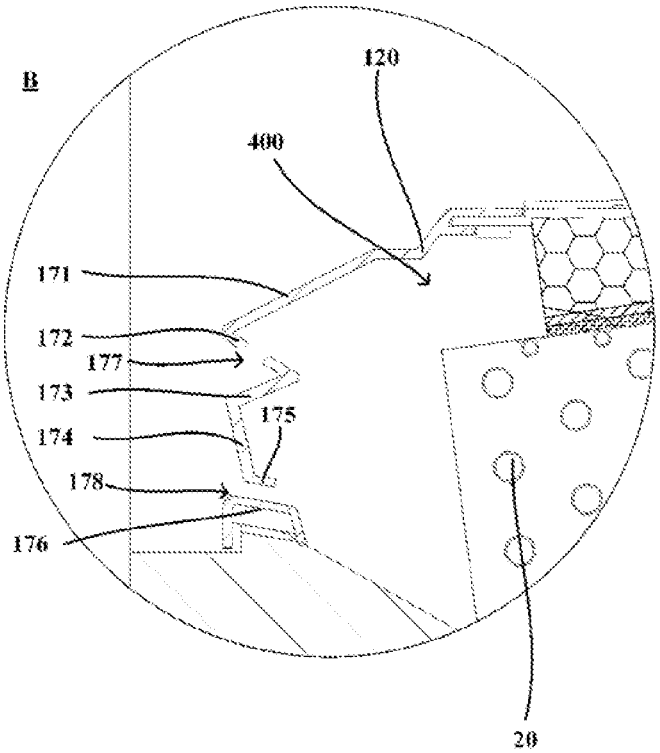
FIG. 5 is a schematic local enlarged view of an area C shown in FIG. 3, which shows a return air cover and a frost-accommodating space.
Figure 6:
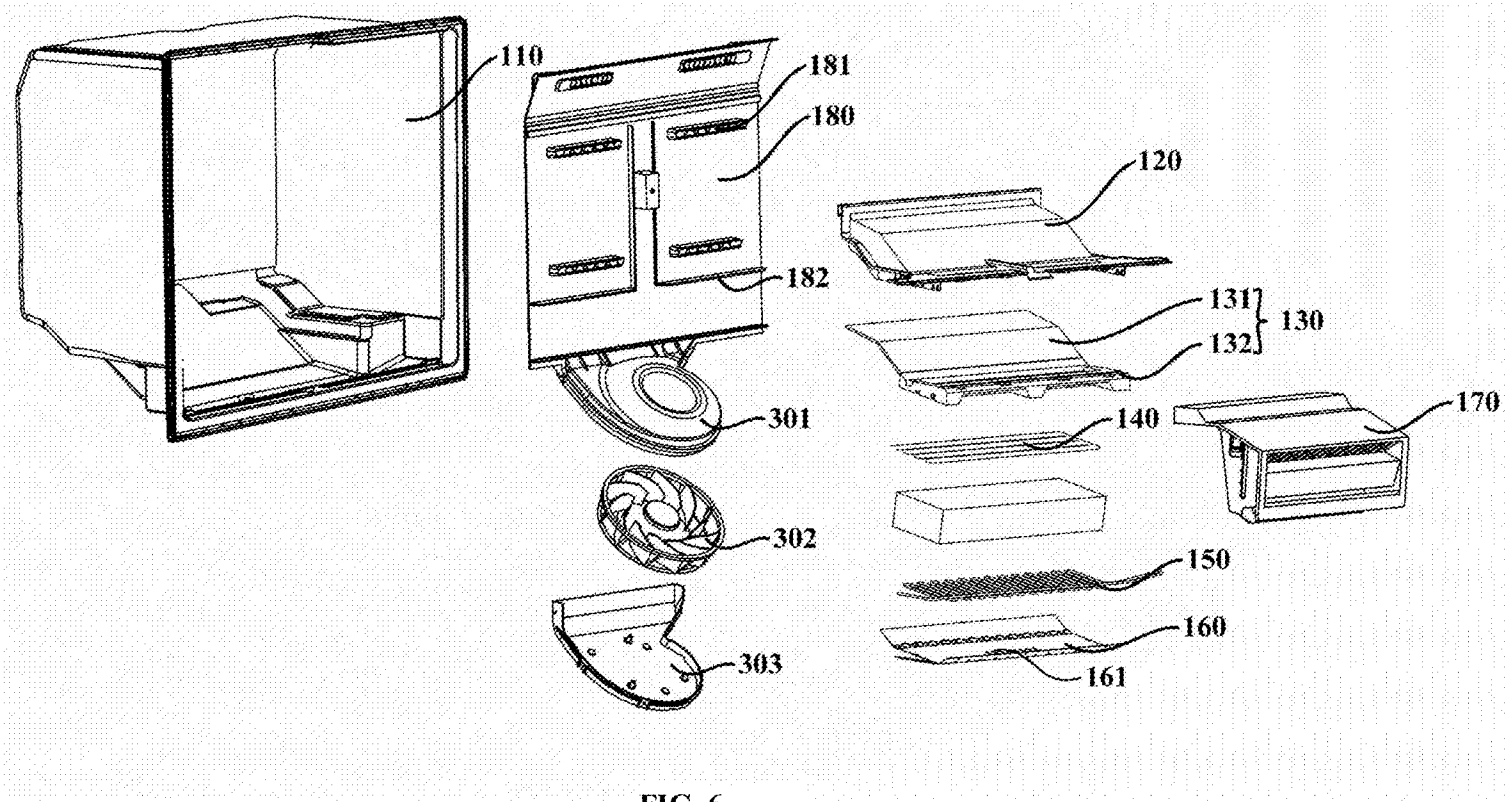
FIG. 6 is a schematic exploded view of the bottom of the cabinet of the refrigerator shown in FIG. 2.
Figure 7:
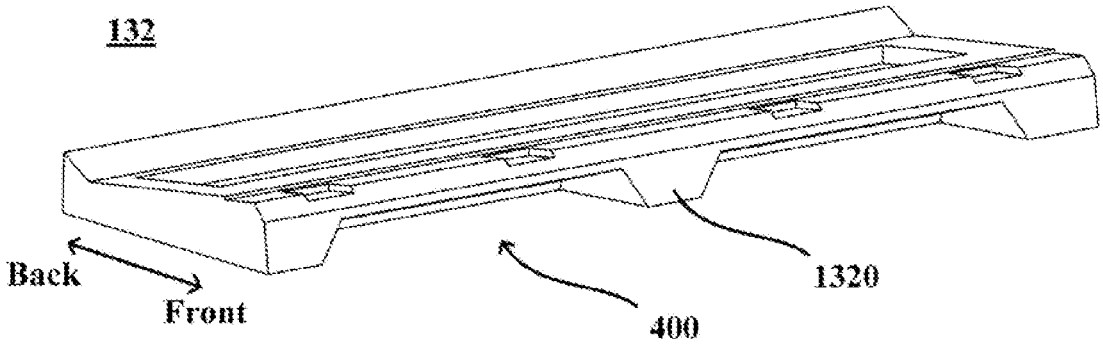
FIG. 7 is a structural schematic diagram of the heating wire limiting portion of the refrigerator shown in FIG. 6.
Figure 8:
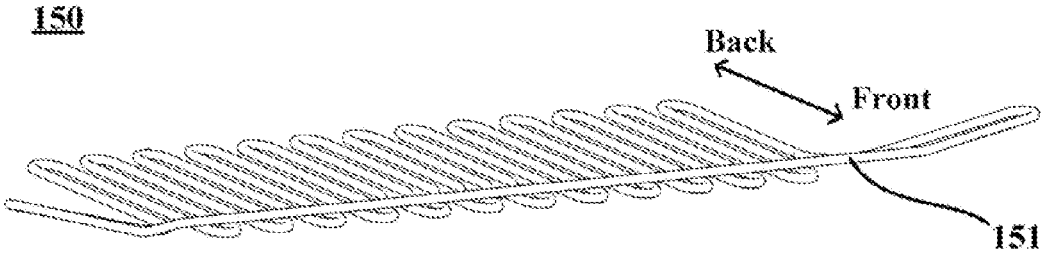
FIG. 8 is a structural schematic diagram of a bottom heating wire of the refrigerator shown in FIG. 6.
Figure 9:
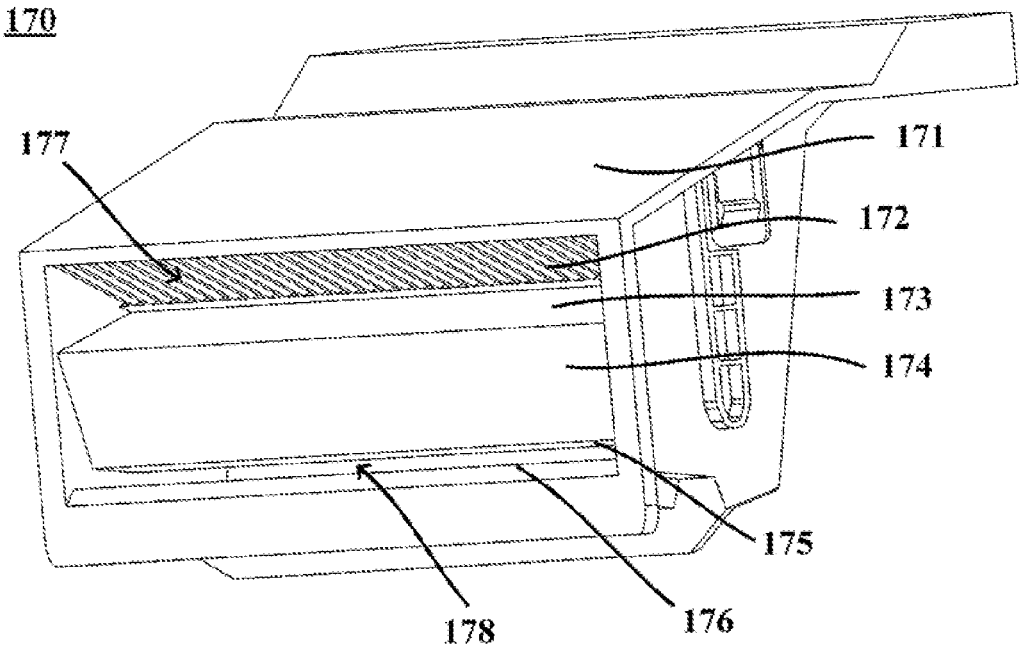
FIG. 9 is a structural schematic diagram of the return air cover of the refrigerator shown in FIG. 6.

FIG. 1 is a schematic front view of an air-cooled refrigerator with an evaporator at a bottom of a cabinet according to an embodiment of the present invention. FIG. 2 is a schematic section view of the air-cooled refrigerator shown in FIG. 1. The refrigerator commonly may include the cabinet 10, and the cabinet 10 includes a shell, a liner and other accessories. The shell is an outer-layer structure of the refrigerator, and protects the whole refrigerator. There may be one or more liners. The liners may be divided into a refrigerating liner, a variable temperature liner, a freezing liner, etc. according to functions, and the specific number and functions of the liners may be configured according to usage requirements of the refrigerator. In the embodiment, the liner at least includes a bottom liner 110 commonly being the freezing liner. A compressor compartment 500 is limited at the rear of the bottom of the cabinet 10.

The refrigerator in embodiments shown in FIG. 3-FIG. 9 is internally provided with a partition cover plate 120. The partition cover plate 120 is transversely arranged in the bottom liner 110 and used for dividing an internal space of the bottom liner 110 into a cooling chamber 100 and a storage space 200, and the cooling chamber 100 is located below the storage space 200.

A return air cover 170 is arranged at a front portion of the cooling chamber 100, and a top of the return air cover 170 is connected to a front end of the partition cover plate 120. The return air cover 170 is provided with at least one front return air inlet communicating the cooling chamber 100 with the storage space 200, and air needed for heat exchange is provided for the cooling chamber 100 by the front return air inlet.

The evaporator 20 in the embodiment is in a flat cuboid shape, and is arranged in the cooling chamber 100 in a manner of inclining upwards from front to back, where a front portion of a top surface of the evaporator 20, the partition cover plate 120 and the return air cover 170 define a frost-accommodating space 400, thereby enabling a part of air inflow from the front return air inlet to enter the evaporator 20 from the frost-accommodating space 400. An original return air flow deflection angle is changed by the frost-accommodating space 400, so that return air flow preferably flows through the frost-accommodating space 400 with low flow resistance and then flows through the evaporator 20, thereby preventing frost of the evaporator 20 from influencing the air flow, improving heat exchange efficiency, and further improving a refrigeration effect of the refrigerator.

The refrigerator in the embodiment further includes a top heating wire 140. The top heating wire 140 is at least arranged at the front portion of the top surface of the evaporator 20 and configured to provide heat needed by defrosting for the evaporator 20. In some embodiments, the top heating wire 140 may be only arranged at the front portion of the top surface of the evaporator (or it may be described that the top heating wire 140 may be only arranged in an area of the frost-accommodating space), thereby facilitating arrangement of the heating wire for centralized defrosting. Thus, a defrosting effect can be improved, and overflow of hot airflow towards the storage space 200 can be avoided as well.

In some other embodiments, the top heating wire 140 may cover the top surface of the whole evaporator 20, and density of the top heating wire 140 is adjusted according to different defrosting heat quantities needed for different positions of the top surface of the evaporator 20. The density of the top heating wire 140 arranged close to the front portion of the top surface of the evaporator 20 is the highest, and then, the density is sequentially reduced backwards, thereby providing enough heat for the frost-accommodating space 400 at the front of the evaporator 20, but the provided heat does not influence normal work of the evaporator 20. Power and actual temperature of the top heating wire 140 may be set section by section, and the temperature does not exceed 80 Celsius degrees, thereby effectively improving a safety level and guaranteeing a defrosting effect. After a structure of the frost-accommodating space 400 is adopted, a frosted position is transferred towards the frost-accommodating space 400 from the front portion of the evaporator 20, thereby facilitating centralized arrangement of the heating wire for defrosting. During defrosting operation, heated hot airflow rises, is stopped by the partition cover plate 120, and then is gathered in the frost-accommodating space 400. Thus, the defrosting effect can be improved, and overflow of the hot airflow towards the storage space 200 can be stopped, thereby improving a fresh keeping effect.

An evaporator heat preservation part 130 is arranged between the partition cover plate 120 and the top of the evaporator 20. By means of the evaporator heat preservation part 130, heat losses of the evaporator 20 can be reduced, and frosting even freezing of the surface of the evaporator 20 can be reduced. Cold energy on a surface of an evaporator 20 of a refrigerator in the prior art is likely to be diffused towards a storage space 200, which causes that a temperature of a bottom area of the storage space 200 is obviously lower than that of other parts of the storage space 200, and consequently, integral temperature distribution in the storage space 200 is uneven. The evaporator heat preservation part 130 used in the embodiment solves the above problems. When the evaporator is defrosted, the evaporator heat preservation part 130 can avoid temperature rise of the storage space 200 due to heat diffuse, namely, energy losses are avoided, and storage quality is prevented from being influenced.

The evaporator heat preservation part 130 is formed by sequentially stacking a plurality of heat preservation layers different in material. The heat preservation layers include a heat preservation foam layer 1301, a resin film layer 1302 and a metal temperature equalization layer 1303.

The heat preservation foam layer 1301 is attached to a lower surface of the partition cover plate 120. The heat preservation foam layer 1301 is light, has certain structure strength, and is arranged on the lower surface of the partition cover plate 120 so as to prevent large objects placed in the storage space 200 from impacting on the cabinet 10.

The resin film layer 1302 is attached to a lower surface of the heat preservation foam layer 1301. The resin film layer 1302 may be set as a polyethylene film (PE film). The polyethylene film is low in specific weight and easily performs cover. The polyethylene film can be closely attached to the upper or lower heat preservation layer after shrinkage, thereby tightly connecting the heat preservation layers being high in integrality and not prone to separation. The polyethylene film is non-toxic, harmless, waterproof, bacteria-proofing, durable, and suitable for a service environment of the refrigerator.

The metal temperature equalization layer 1303 is arranged on an outer side of the resin film layer 1302 and is opposite to the top of the evaporator 20. The metal temperature equalization layer 1303 may be set as aluminum foil. The aluminum foil is high in ductility, which can reduce a thickness of the metal temperature equalization layer 1303 to the maximum degree and prevent an internal space of the refrigerator from being occupied excessively; and the aluminum foil is excellent in heat-conducting property, thereby equalizing the temperature of the top of the evaporator 20, and solving a problem about uneven temperature distribution of the storage space 200 above the evaporator 20.

The evaporator heat preservation part 130 includes a filling portion 131 and a heating wire limiting portion 132. An area, located behind the frost-accommodating space 400, between the partition cover plate 120 and the top surface of the evaporator 20 is filled with the filling portion 131. The heating wire limiting portion 132 extends forwards from the filling portion 131 and is provided with at least one downwards-protruding convex rib 1320 which can tightly press the top heating wire 140 on the top surface of the evaporator 20. A plurality of convex ribs 1320 are located above a transverse middle portion and two transverse sides of the top heating wire 140 respectively to fix the top heating wire 140 more stably.

The heating wire limiting portion 132 is made into an E-shaped structure to limit a middle portion of the top heating wire 140 at the top surface of the evaporator 20. The metal temperature equalization layer 1303 is arranged in the evaporator heat preservation part 130 and makes contact with the top heating wire 140, which can effectively transfer energy and prevent a local temperature of the top heating wire 140 from being too high. The above settings simplify a limiting structure of the top heating wire 140, and the top heating wire 140 is fixed only through the evaporator heat preservation part 130 without additionally arranging an aluminum plate, thereby improving safety, simplifying the structure and facilitating installation.

A bottom wall of the bottom liner 110 is further provided with a water receiving trough 111, and a bottom of the water receiving trough 111 is provided with a water outlet 112. The water outlet 112 guides defrosting water generated after defrosting into an evaporation dish 510 in the compressor compartment 500.

The air-cooled refrigerator may further include a water pan 160. The water pan 160 is arranged between the evaporator 20 and the bottom wall of the bottom liner 110 and configured to receive water on the evaporator 20; and an area, opposite to the water receiving trough 111, of the water pan 160 is provided with a plurality of through holes 161 used for guiding the defrosting water generated after defrosting into the water pan 160.

The refrigerator in the embodiment further includes a bottom heating wire 150. The bottom heating wire 150 is coiled between the water pan 160 and the evaporator 20 and configured to provide heat for defrosting of the evaporator 20. The bottom heating wire 150 further includes: a front extension section 151 which extends to a position in front of the evaporator 20 from the bottom of the evaporator 20 and is used for heating and melting away frost falling down from the frost-accommodating space 400 during defrosting. In a defrosting process, the frost falling down from the frost-accommodating space 400 is melted away through the front extension section 151 of the bottom heating wire 150. The bottom heating wire 150 and the water pan 160 are fixed together, which can guarantee uniform heat transfer; and the water pan 160 may also have a safety protection function in a transportation process. Power density of the front extension section 151 does not exceed 10 w/m due to less heat needed at the position, thereby effectively improving the safety level according to the design.

Power of the bottom heating wire 150 and the top heating wire 140 is designed according to needs, which can guarantee the defrosting effect and meanwhile reduce energy waste and temperature rise of a freezer compartment, thereby improving the fresh keeping effect of the freezer compartment.

The return air cover 170 in the embodiment is provided with a first front return air inlet 177 and a second front return air inlet 178. The first front return air inlet 177 is transversely formed in an upper portion of the return air cover 170. The second front return air inlet 178 is transversely formed in a lower portion of the return air cover 170, so that air in the storage space 200 flows towards the evaporator 20 from an upper area and a lower area.

The return air cover 170 may include a first board 171, a second board 172, a third board 173, a fourth board 174, a fifth board 175 and a frame 176.

The first board 171 extends obliquely downwards from back to front from the front end of the partition cover plate 120. The second board 172 extends obliquely downwards from front to back from a front end of the first board 171 to be concaved in a direction towards the cooling chamber 100.

The first front return air inlet 177 is formed in the second board 172. The first front return air inlet 177 is formed by grid holes formed in the second board 172. A structure of a return air cover 170 in the prior art is likely to cause uneven return air volume distribution, airflow gathering nearby a return air inlet (e.g., a front end of an upper cover of the return air cover and an internal bending position of the upper cover of the return air cover), thus influencing air return efficiency. The second board 172 of the return air cover 170 in the embodiment inclines inwards, and thus, a set position of the first front return air inlet 177 extends in a direction towards the cooling chamber 100. When flowing through the first board 171, the airflow can be downwards guided due to downward inclination of the first board 171. When flowing through a corner towards an interior of the cooling chamber 100 formed by the first board 171 and the second board 172, the airflow may evenly flow into the cooling chamber 100 along with vortexes in the corner, thereby avoiding situations of uneven air volume distribution and gathering, improving air return efficiency and making air return smoother. A grid is formed at the front return air inlet. The grid holes are in a vertical strip shape and are sequentially distributed in a transverse direction to disperse return air, thereby enabling the return air to more evenly enter an upper section of the evaporator 20. The first front return air inlet 177 is basically flush with the top surface of the evaporator 20 in a vertical direction so that airflow entering the cooling chamber 100 from the first front return air inlet 177 can evenly exchange heat with the evaporator 20. The frost-accommodating space 400 is arranged at the front portion of the evaporator 20, which changes the original return air flow deflection angle, so that the airflow preferably flows through the frost-accommodating space 400 with low flow resistance and then flows through the evaporator 20, and thus airflow heat exchange in the evaporator 20 is more uniform. Setting a reasonable size of the frost-accommodating space 400 according to simulated analysis and frosting amount calculation can balance usage efficiency of the evaporator 20 before and after defrosting, thereby integrally improving the refrigeration effect.

Air, outside the cabinet 10, inflowing from the first front return air inlet 177 is frosted in the frost-accommodating space 400 after making contact with the cold surface of the evaporator 20; and the top heating wire 140 arranged on the top surface of the evaporator 20 provides enough heat for the frost-accommodating space 400 at the front portion of the evaporator 20 for defrosting, but the provided heat does not influence normal work of the evaporator 20.

The third board 173 extends obliquely downwards from back to front from a rear end of the second board 172 to protrude forwards. The fourth board 174 extends obliquely downwards from front to back from a front end of the third board 173 to be concaved in a direction towards the cooling chamber 100. The fifth board 175 downwards obliquely extends backwards from a rear end of the fourth board 174.

The second front return air inlet 178 is formed between the fifth board 175 and the frame 176, and is basically flush with a middle portion of the evaporator 20 in the vertical direction so that airflow entering the cooling chamber 100 from the second front return air inlet 178 can evenly exchange heat with the evaporator 20.

The air-cooled refrigerator in the embodiment may further include an air duct back plate 180. The air duct back plate 180 is arranged in front of a rear wall 113 of the bottom liner 110 and defines, with the rear wall 113 of the bottom liner 110, an air supply duct 300; and the air duct back plate 180 is provided with at least one air supply port 181 used for communicating the air supply duct 300 with the storage space 200. The air duct back plate 180 may be further provided with water retaining ribs 182. The water retaining ribs 182 may be arranged on one side, towards a storage compartment, of the air duct back plate 180. Since the airflow contains part of condensate water, the condensate water can be attached to a surface of the air duct back plate 180 when the airflow encounters the air duct back plate 180, and the water retaining ribs 182 can reduce a falling speed of the condensate water to make all the condensate water evaporate as much as possible, and prevent the condensate water from falling into a fan cavity and causing faults. In the embodiment, transverse extension may refer to horizontal extension and may also be understood that the water retaining ribs 182 have a certain inclination angle. The two above manners both can reduce the falling speed of the condensate water on the water retaining ribs 182.

A refrigeration fan 30 of the refrigerator in the embodiment is arranged behind the evaporator 20, an air outlet 310 of the refrigeration fan 30 is connected to a lower end of the air supply duct 300, and the refrigeration fan 30 is configured to promote formation of a refrigeration airflow which flows into the evaporator 20 from the front return air inlets and then is supplied to the air supply duct 300. In an embodiment in which a centrifugal fan is used as the refrigeration fan 30, the centrifugal fan may include a fan bottom shell 303, fan blades 302 and a fan upper cover 301. An air inlet of the centrifugal fan is commonly located in a center of the fan upper cover 301 and may be higher than a top end of the evaporator 20 to enlarge an air inlet space. The fan upper cover 301 and the air duct back plate 180 belong to a single-layer board formed through integrated injection molding, thereby simplifying installation steps.

In the air-cooled refrigerator with the evaporator 20 at the bottom of the cabinet 10 in the embodiment, the front portion of the top surface of the evaporator 20, the partition cover plate 120 and the return air cover 170 define the frost-accommodating space 400, thereby enabling a part of air inflow from the front return air inlets to enter the evaporator 20 from the frost-accommodating space 400. The original return air flow deflection angle is changed by the frost-accommodating space 400, so that the return air flow preferably flows through the frost-accommodating space 400 with low flow resistance and then flows through the evaporator 20, thereby preventing frost of the evaporator 20 from influencing the air flow, improving heat exchange efficiency, and further improving the refrigeration effect of the refrigerator.

Furthermore, the top heating wire 140 is arranged at the front portion of the top surface of the evaporator 20. By means of the frost-accommodating space 400, the frosted position is transferred into the frost-accommodating space from the front portion of the evaporator 20, and the top heating wire 140 is arranged at the front portion of the top surface of the evaporator 20 in a centralized manner, thereby preventing heat of the heating wire from influencing refrigeration work of the evaporator 20 during defrosting, optimizing a defrosting structure of the refrigerator, further improving the refrigeration efficiency of the refrigerator, and reducing energy consumption.

Furthermore, the heating wire limiting portion 132 limits the top heating wire 140 at the top surface of the evaporator 20. The metal temperature equalization layer 1303 is arranged in the heating wire limiting portion 132 and makes contact with the top heating wire 140, which can effectively transfer energy and prevent the local temperature of the top heating wire 140 from being too high. The above settings simplify the limiting structure of the top heating wire 140, and the top heating wire 140 is fixed only through the evaporator heat preservation part 130 without additionally arranging the aluminum plate, thereby improving safety, simplifying the structure and facilitating installation.

Herein, those skilled in the art can realize that the Description has shown and described a plurality of exemplary embodiments of the present invention in detail, but, many other variations or modifications conforming to the principle of the present invention still can be directly determined or deduced according to the content disclosed by the present invention without departing from the spirit and the scope of the present invention. Thus, the scope of the present invention needs to be understood and affirmed to cover all these other variations or modifications.

What is claimed is:

1. An air-cooled refrigerator with an evaporator at a bottom of a cabinet, comprising:

the cabinet with a bottom liner;

a partition cover plate transversely arranged in the bottom liner and used for dividing an internal space of the bottom liner into a cooling chamber and a storage space, wherein the cooling chamber is located below the storage space;

a return air cover arranged at a front portion of the cooling chamber, wherein, a top of the return air cover is connected to a front end of the partition cover plate, the return air cover is provided with at least one front return air inlet that communicates the cooling chamber with the storage space, and air needed for heat exchange is provided for the cooling chamber through the front return air inlet; and the evaporator, wherein the evaporator is in a flat cuboid shape, and is arranged in the cooling chamber in a manner of inclining upwards from front to back, and a front portion of a top surface of the evaporator, the partition cover plate and the return air cover define a frost-accommodating space, thereby enabling a part of air inflow from the front return air inlet to enter the evaporator from the frost-accommodating space;

wherein the air-cooled refrigerator further comprises:

a top heating wire at least arranged at the front portion of the top surface of the evaporator and configured to provide heat needed by defrosting for the evaporator; and an evaporator heat preservation part arranged between the partition cover plate and a top of the evaporator, which comprises:

a filling portion with which an area region, located behind the frost-accommodating space, between the partition cover plate and the top surface of the evaporator is filled; and a heating wire limiting portion extending forwards from the filling portion.

2. The air-cooled refrigerator with the evaporator at the bottom of the cabinet according to claim 1, wherein the heating wire limiting portion is provided with at least one downwards-protruding convex rib which can tightly press the top heating wire on the top surface of the evaporator.

3. The air-cooled refrigerator with the evaporator at the bottom of the cabinet according to claim 2, wherein a plurality of convex ribs are located above a transverse middle portion and two transverse sides of the top heating wire respectively.

4. The air-cooled refrigerator with the evaporator at the bottom of the cabinet according to claim 1, wherein the evaporator heat preservation part is formed by sequentially stacking a plurality of heat preservation layers different in material, and the heat preservation layers comprise:

a heat preservation foam layer attached to a lower surface of the partition cover plate;

a resin film layer attached to a lower surface of the heat preservation foam layer; and a metal temperature equalization layer arranged on an outer side of the resin film layer and abutting against the top heating wire.

5. The air-cooled refrigerator with the evaporator at the bottom of the cabinet according to claim 1, wherein a bottom wall of the bottom liner is further provided with a water receiving trough, and a bottom of the water receiving trough is provided with a water outlet; and the air-cooled refrigerator further comprises:

a water pan arranged between the evaporator and the bottom wall of the bottom liner and configured to receive water on the evaporator, an area, opposite to the water receiving trough, of the water pan being provided with a plurality of through holes; and a bottom heating wire coiled between the water pan and the evaporator and configured to provide heat for defrosting of the evaporator.

6. The air-cooled refrigerator with the evaporator at the bottom of the cabinet according to claim 5, wherein the bottom heating wire further comprises: a front extension section which extends to a position in front of the evaporator from a bottom of the evaporator and is used for heating and melting away frost falling down from the frost-accommodating space during defrosting.

7. The air-cooled refrigerator with the evaporator at the bottom of the cabinet according to claim 6, wherein power density of the front extension section is set to be less than or equal to 10 w/m.

8. The air-cooled refrigerator with the evaporator at the bottom of the cabinet according to claim 1, wherein the return air cover is provided with:

a first front return air inlet transversely formed in an upper portion of the return air cover; and a second front return air inlet transversely formed in a lower portion of the return air cover, so that air in the storage space flows towards the evaporator from an upper area and a lower area.

9. The air-cooled refrigerator with the evaporator at the bottom of the cabinet according to claim 1, further comprising:

an air duct back plate which is arranged in front of a rear wall of the bottom liner, defines, with the rear wall of the bottom liner, an air supply duct, and is provided with at least one air supply port used for communicating the air supply duct with the storage space; and a refrigeration fan arranged behind the evaporator, wherein an air outlet of the refrigeration fan is connected to a lower end of the air supply duct, and the refrigeration fan is configured to promote formation of a refrigeration airflow which flows into the evaporator from the front return air inlet and then is supplied to the air supply duct.

10. An air-cooled refrigerator with an evaporator at a bottom of a cabinet, comprising:

the cabinet with a bottom liner;

a partition cover plate transversely arranged in the bottom liner and used for dividing an internal space of the bottom liner into a cooling chamber and a storage space, wherein the cooling chamber is located below the storage space;

a return air cover arranged at a front portion of the cooling chamber, wherein, a top of the return air cover is connected to a front end of the partition cover plate, the return air cover is provided with at least one front return air inlet that communicates the cooling chamber with the storage space, and air needed for heat exchange is provided for the cooling chamber through the front return air inlet; and the evaporator, wherein the evaporator is in a flat cuboid shape, and is arranged in the cooling chamber in a manner of inclining upwards from front to back, and a front portion of a top surface of the evaporator, the partition cover plate and the return air cover define a frost-accommodating space, thereby enabling a part of air inflow from the front return air inlet to enter the evaporator from the frost-accommodating space, wherein a bottom wall of the bottom liner is further provided with a water receiving trough, and a bottom of the water receiving trough is provided with a water outlet; and the air-cooled refrigerator further comprises:

a water pan arranged between the evaporator and the bottom wall of the bottom liner and configured to receive water on the evaporator; and a bottom heating wire coiled between the water pan and the evaporator and configured to provide heat for defrosting of the evaporator, wherein the bottom heating wire further comprises: a front extension section which extends to a position in front of the evaporator from a bottom of the evaporator and is used for heating and melting away frost falling down from the frost-accommodating space during defrosting.

11. The air-cooled refrigerator with the evaporator at the bottom of the cabinet according to claim 10, wherein an area, opposite to the water receiving trough, of the water pan is provided with a plurality of through holes.

12. The air-cooled refrigerator with the evaporator at the bottom of the cabinet according to claim 10, wherein power density of the front extension section is set to be less than or equal to 10 w/m.

13. The air-cooled refrigerator with the evaporator at the bottom of the cabinet according to claim 10, wherein the return air cover is provided with:

a first front return air inlet transversely formed in an upper portion of the return air cover; and a second front return air inlet transversely formed in a lower portion of the return air cover, so that air in the storage space flows towards the evaporator from an upper area and a lower area.

14. The air-cooled refrigerator with the evaporator at the bottom of the cabinet according to claim 10, further comprising:

an air duct back plate which is arranged in front of a rear wall of the bottom liner, defines, with the rear wall of the bottom liner, an air supply duct, and is provided with at least one air supply port used for communicating the air supply duct with the storage space; and a refrigeration fan arranged behind the evaporator, wherein an air outlet of the refrigeration fan is connected to a lower end of the air supply duct, and the refrigeration fan is configured to promote formation of a refrigeration airflow which flows into the evaporator from the front return air inlet and then is supplied to the air supply duct.

* * * * *